United States Patent [19]

Bastion et al.

[11] Patent Number: 4,532,963

[45] Date of Patent: Aug. 6, 1985

[54] WEAVING MECHANISM WITH IMPROVED SELECTION OF THE HOOKS

[75] Inventors: Patrick Bastion, Lyon; Francois Lhuillier; Ulrich Mutschler, both of Caluire, all of France

[73] Assignee: Societe Staubli-Verdol, Lyon, France

[21] Appl. No.: 548,118

[22] Filed: Nov. 2, 1983

[30] Foreign Application Priority Data

Nov. 4, 1982 [FR] France ..... 82 18725

[51] Int. Cl.[3] ..... D03C 3/00; D03C 3/20; D03C 13/00

[52] U.S. Cl. ..... 139/59; 139/55.1; 139/455

[58] Field of Search ..... 139/59, 60, 455, 55.1, 139/319

[56] References Cited

U.S. PATENT DOCUMENTS 3,265,096 8/1966 Zangerle et al. ..... 139/59

3,835,894 9/1974 Speich ..... 139/59 X 4,060,101 11/1977 Seiler ..... 139/59 X 4,416,310 11/1983 Sage ..... 139/59

*Primary Examiner*—James Kee Chi

*Attorney, Agent, or Firm*—Dowell & Dowell

[57] ABSTRACT

A mechanism for selecting and raising heddle hooks in a weaving loom in response to control signals delivered by a pattern reader, wherein the mechanism includes a flexible blade for each hook and further includes a catch associated with each blade and operable to connect the blade with the hook thereby to select the hook, and the mechanism further including an electro magnetic coil operative for selecting each blade and catch in response to said control signals delivered to a shift register whose stages energize the coils, the hooks being supported by one plate and the selecting mechanisms being supported by another plate, the plates reciprocating toward and away from each other in synchronism with the loom motion.

11 Claims, 11 Drawing Figures

WEAVING MECHANISM WITH IMPROVED SELECTION OF THE HOOKS

The present invention relates to improvements in the system for selecting the hooks of a waving mechanism with a view to allowing fashioned fabrics to be produced, i.e. necessitating a very large number of warp yarns having to be raised or lowered. Such fabrics constitute pictures, tapestries or other engravings for which manual looms have been used up to the present. In an earlier French Pat. No. 80 04281, which corresponds with U.S. Pat. No. 4,416,310 to Sage the present Applicants proposed producing a device for controlling the warp yarns with a view to effecting opening of the shed by dividing this device into separable modules each comprising blades which pass through a first plate provided with bars and a second plate provided with perforations. The blades each bear a shoe and a hook. When electro-magnets attract the blades, the hooks of the attracted blades are displaced by the first plate whilst those not attracted follow the translation of the second plate. The shed is thus opened by the translation of the two plates.

Such a weaving mechanism is highly complex and requires considerable precision of production of all its elements with a view to guaranteeing the relative position of each blade with respect to its electro-magnet and to the lifting plate. It is provided with a large number of mobile elements with the result that, to avoid any premature wear and with a view to obtaining the precision indispensable for producing all the elements, such a mechanism is very expensive. In addition, it requires long and tedious adjustments to guarantee simultaneous functioning of about ten thousand blades. In this connection it should be noted that the metallic blades must be brought into contact with their electro-magnet and that the least air gap may jeopardize the retaining of the blades since the force of attraction of an electro-magnet decreases in manner inversely proportional to the size of the air gap.

In addition, in the case of failure of a metallic blade, it is necessary to replace the latter, by causing it to traverse the plates which are in reality four in number.

If an electro-magnet is defective, it must be withdrawn from its support through the guide plate or to one side. It will be readily understood that, due to the very high density of the components, the electro-magnets are not easily accessible.

The improvements forming the subject matter of the present invention aim at overcoming these drawbacks and allowing production of a weaving mechanism with a very large number of hooks while at the same time allowing the replacement of all its components rapidly and simply whilst ensuring a considerable reduction of its cost price with respect to that of the apparatus manufactured previously. By the general arrangement and mode of control, the consumption of electrical energy necessary for operation of the mechanism may, thanks to the invention, be considerably reduced.

To this end, the weaving mechanism according to the invention now comprises only two mobile plates of which the first is used for lowering the warp yarns, which plate supports the non-selected hooks which make it possible to form the lower layer of the shed whilst guiding the selected hooks which produce the upper layer, the former being brought into high position by a second plate. The latter comprises flexible blades provided with a catch adapted to cooperate with the selected hooks with a view to raising them.

This selecting action is firstly obtained by displacing the blade by a ramp of the lower plate so as to bring it into contact with a pole of a magnetic circuit of which the blade forms part. If it is desired that the hook be raised, the retaining of the blade is released by cancelling the action of the permanent magnetic circuit. The assembly formed by the blades and their magnetic circuits is divided into modules of twenty four elements, each module having its own electrical supply means.

The accompanying drawing, given by way of example, will enable the invention, the characteristics that it presents and the advantages that it may procure, to be more readily understood.

FIGS. 1 and 2 schematically show a weaving mechanism set up according to the invention in a position of closed shed and oblique open shed, respectively.

Figure 1:
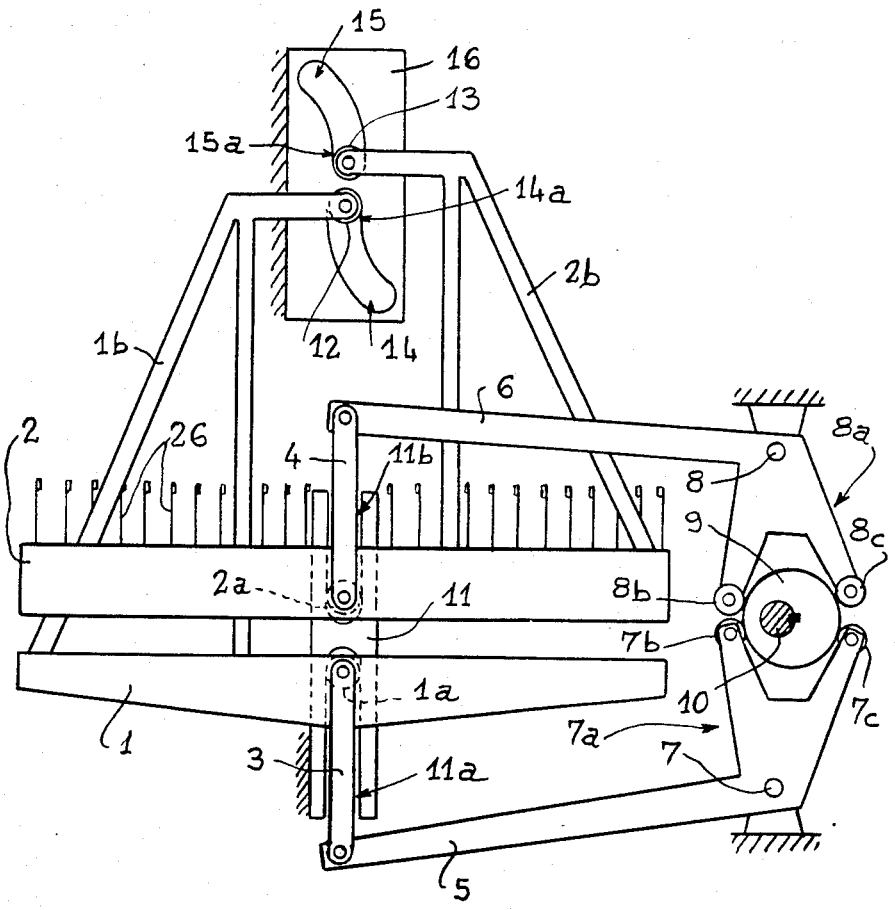
Figure 2:
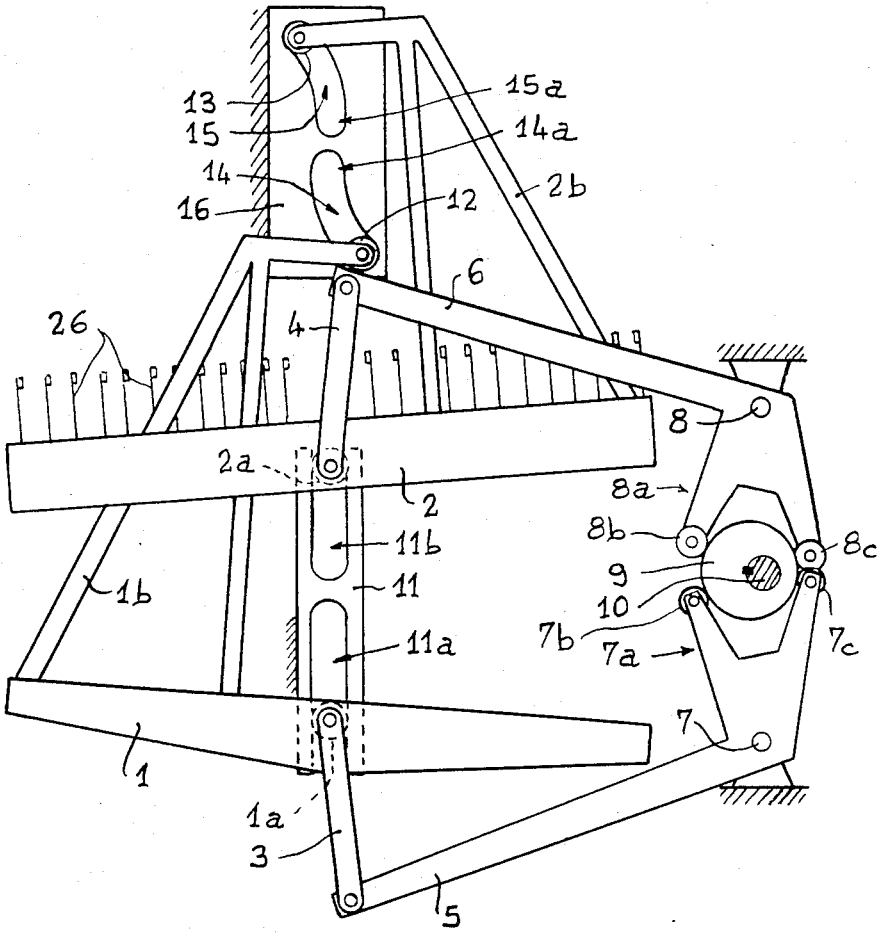

FIGS. 1 and 2 very schematically illustrate a weaving mechanism to which the improvements according to the invention are applied. This mechanism essentially comprises two mobile plates 1 and 2, one lower one bearing the hooks, the other higher one supporting the selection system. Each of the plates is connected by a connecting rod 3, 4, to a bent balance beam 5, 6 articulated about a fixed pivot pin 7, 8. The bent part of the balance beams takes the form of a fork 7*a*, 8*a* of which the ends of the prongs are associated with cam follower free rollers 7*b*, 7*c*, 8*b*, 8*c*, respectively, which cooperate with cams and counter-cams 9. The rotation of these latter which are fixed on a rotating shaft 10 brings about tipping of the balance beams 5 and 6 and the vertical displacement of plates 1 and 2. To this end, each of the latter comprises an outer finger 1*a*, 2*a* which moves in opposite slides 11*a*, 11*b* of a vertical guide 11.

Each plate carries a roller 12, 13 respectively, mounted freely at the end of a bracket 1*b*, 2*b* and which is located inside a slot 14, 15, respectively, in a fixed plate 16. Each slot 14, 15 comprises a vertical part 14, 15*a* which ensures a displacement of the two plates parallel to themselves, then each slot is curved so that, after having effected their stroke parallel to themselves corresponding to the phase of selection, the two plates come into a mutually oblique position as illustrated in FIG. 2.

Thanks to this arrangement, a lifting and lowering mechanism comprising an oblique shed is produced.

Figure 3:
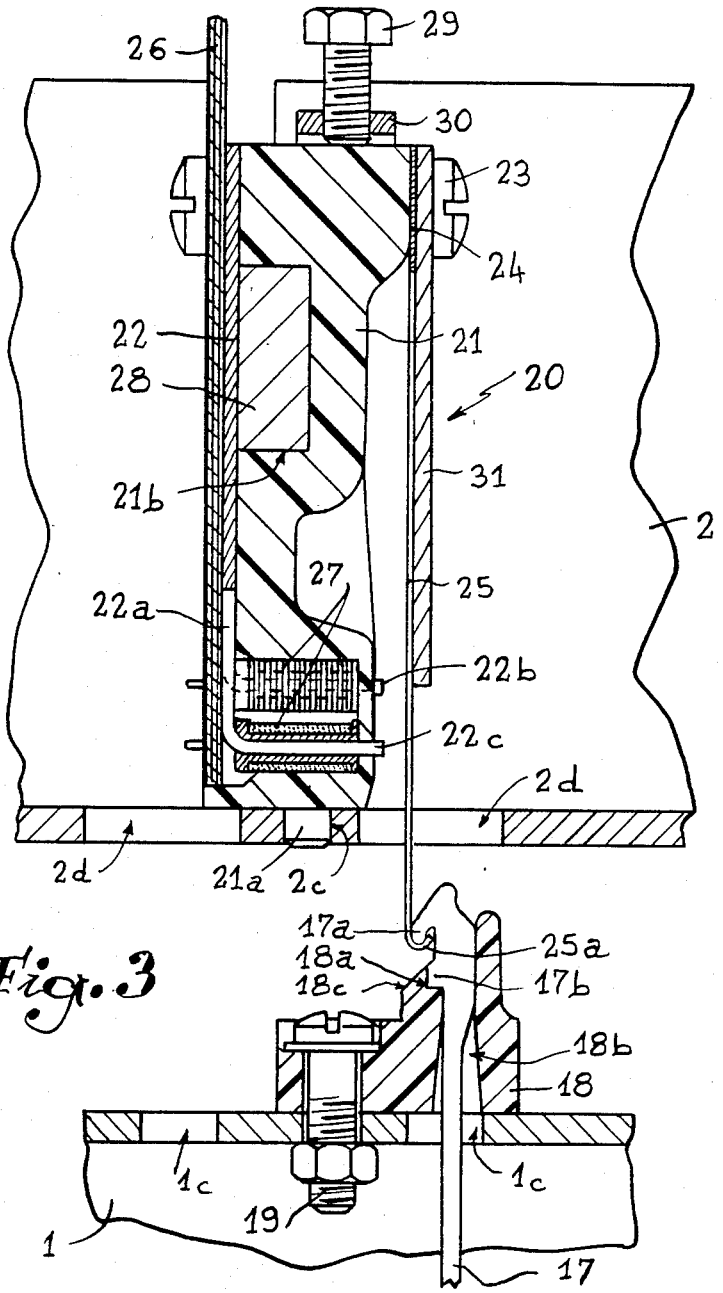
FIG. 3 is a vertical section on a large scale of the system for selecting the hooks.

As illustrated in FIG. 3, the plate 1 is provided with holes 1*c* intended for the passage of the hooks 17 of the weaving mechanism according to the invention. The lower part of the hook 17 which is associated with a heddle as is well known in the art will not be described. The upper part of the hook comprises a beak 17*a* beneath which is found a swell or heel 17*b* which rests on a shoulder 18*a* of a guide 18 associated with the top of the plate 1 by means of an assembly bolt 19. It will be observed that the shoulder 18*a* is located at the upper end of a vertical conical bore 18*b* made in the guide 18 in register with hole 1*c* in the plate 1.

The upper plate 2 supports modules 20 of the selection system, each module being intended for controlling twenty four hooks.

Figure 4:
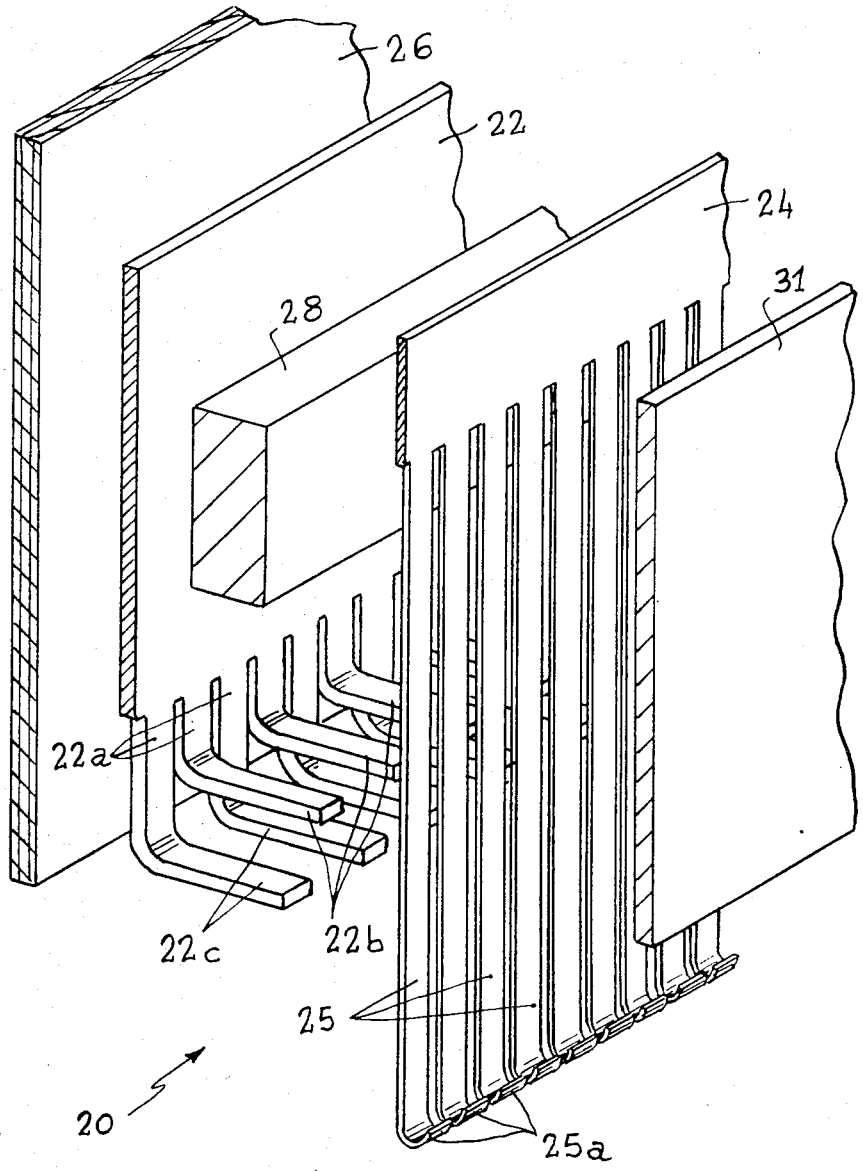
FIG. 4 is an exploded partial view thereof.

Each module 20 comprises a support 21 made of non-magnetic material such as a thermoplastic resin, which comprises centering studs 21*a* engaging in corresponding holes 2*c* in the plate 2. The support 21 is firstly associated with a single pole piece 22 made in the form of a flat plate extended by tongues 22*a* curved at 90° with respect to the general plane of said plate to form teeth 22*b*, 22*c* offset longitudinally. This pole piece 22 is shown in detail in FIG. 4, in which is clearly seen the offset of the teeth 22*b* and 22*c* heightwise. It is also observed that the teeth 22*b* are shorter than those 22*c*. The polar piece 22 is assembled on the support 21 by means of bolts 23 which also maintain a reed 24 whose blades 23 oriented downwardly pass through the plate 2 in openings 2*d*. The end of each blade 25 is curved upwardly to form a catch 25*a* intended to cooperate with the beak 17*a* of the corresponding hook 17.

The bolts 23 also maintain a panel 26 in which is imprinted the control circuit of the coils 27 engaged around the teeth 22*b* and 22*c* of the pole piece.

A permanent magnet 28 is disposed parallel to the lower face of the plate 2 in a cavity 21*b* in the support 21.

The different supports 21 are assembled together by means of centering devices (not shown), the supports being fixed to the plate 2 by means of set screws 29 engaged in tapped holes made in a fixed stirrup element 30.

Finally, the presence is observed of a plate 31 maintained in abutment against the reed 24 and its blades 25, this plate being assembled on the other elements of module 20 by the bolts 23. This plate is intended to dampen the vibrations of the blades.

Figure 5:
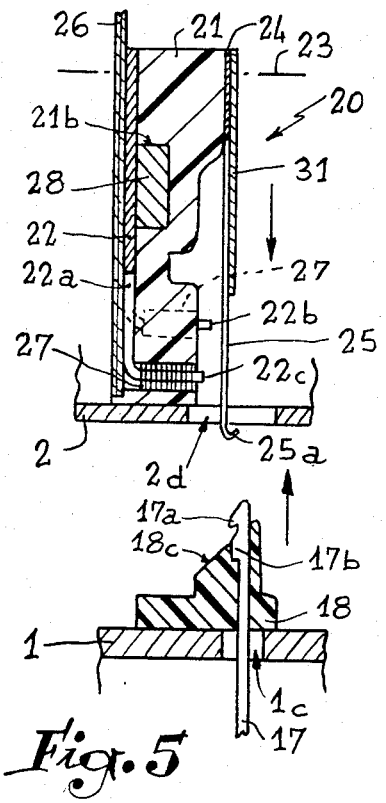
FIGS. 5 to 8 are views similar to FIG. 3, on a smaller scale, but illustrating the selection system in its different positions.
Figure 6:
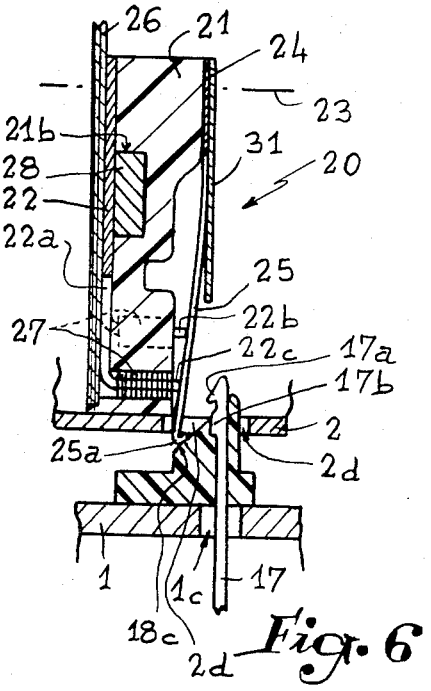

Operation follows from the foregoing explanations: When the two plates move closer to each other (FIG. 5), the catch 25*a* of the blade 25 corresponding to each hook 17 comes into contact with an oblique ramp 18*c* made in the guide 18 so that the blade is displaced in the direction of the pole piece as illustrated in FIG. 6. At bottom dead centre of the upper plate 2, the blade 25 in question comes into contact with one of the teeth of the polar piece so that it is retained in this position due to the existence of a magnetic flux established by the permanent magnet 28, the pole piece 22, the blade 25 and an air gap located between the latter and the magnet 28.

Figure 7:
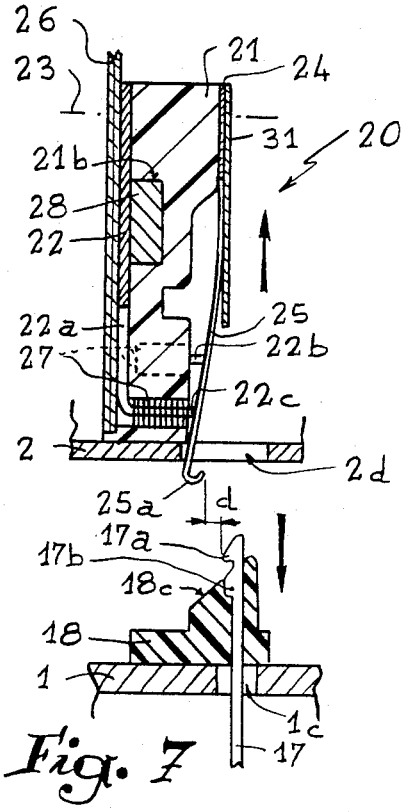

When the two plates 1 and 2 move away from each other again, the catch 25*a* cannot grip the beak 17*a* of the hook (FIG. 7) due to the distance d existing between these two elements with the result that the hook 17 redescends with the plate 1. In this case, the hook in question is not selected.

Figure 8:
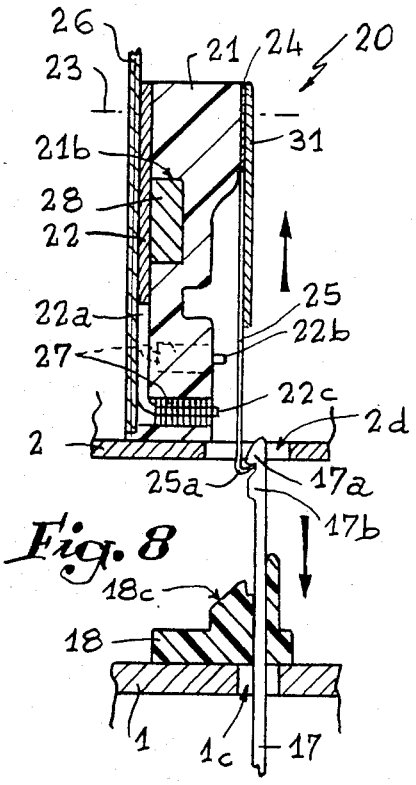

On the contrary, if the permanent magnetic flux is cancelled for example by energizing the coil 27 disposed around the tooth with which the blade is in contact, as soon as the two plates move away from each other, the catch 25*a* of the blade 25 will cooperate with the ramp 18*c* to grip the beak 17*a* of the hook 17 (FIG. 8); under these conditions, the hook in question will be selected, i.e. the warp yarn to which it is connected will be raised.

Figure 9:
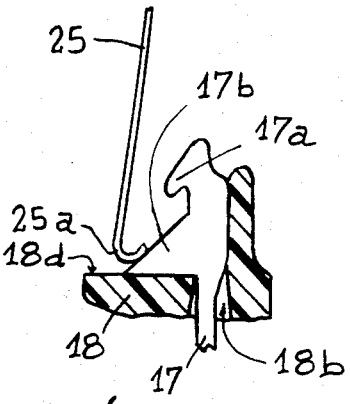
FIG. 9 is a modified embodiment of the ramp intended for offsetting the blades.

FIG. 9 illustrates a modification in which it is the hook 17 itself which bears the ramp for deforming the blade 25. To this end, its heel 17*b* is extended so as to constitute said ramp. The lower face of the heel then rests against a flat portion 18*d* of the guide 18.

Figure 10:
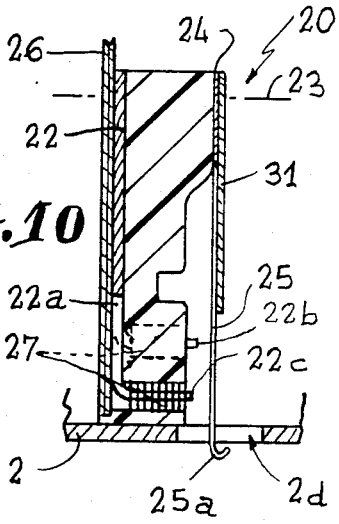
FIG. 10 is a view similar to that of FIG. 3, but showing modified manner of retaining the blades.

According to another modification, the permanent magnet 28 may be eliminated and blade 25 retained, when it comes into abutment against one of the teeth 22*b*, 22*c* of the polar piece 22, by energizing the corresponding coil 27 (FIG. 10) to constitute an electro-magnet retaining the blade in a displaced position. Conversely to what has been described above, it is by eliminating energization of the coil that the blade 25 would be released so that it is gripped by the hook.

With a view to energizing the coils, the mechanism is provided with a printed circuit embedded in the panel 26. As it is a question of controlling a very large number of coils referenced $27_1$ to $27n$ independently of one another, the printed circuit has been implanted close to the coils in order to reduce the length of the conductors.

Figure 11:
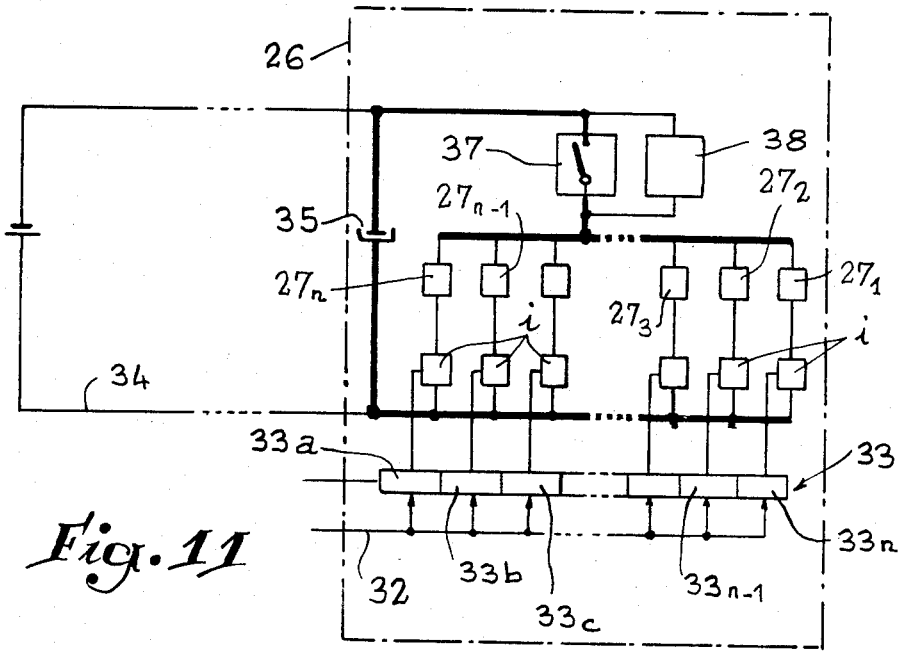
FIG. 11 is a diagram of the electrical circuit intended for the operation of a module of the selection system.

The control information coming from the selection reader is sent by one wire 32 (FIG. 11). This information terminates in a shift register 33 of known type. The control of the register introduces to its input the first item of information in its first stage 33*a*. The information for the second coil is then presented at the input of register 33. The shift control then places the contents of stage 33*a* in stage 33*b* and places at 33*a* the information for coil $27_2$. The information for coil $27_3$ then presents itself then the shift control causes the contents of stages 33*a* and 33*b* to pass respectively into stages 33*b* and 33*c*, whilst the information for the third coil is introduced into stage 33*a*. The information arriving progressively, operation of the shift register is effected in the same manner up to the introduction of the information for the last coil 27*n*. There are therefore only two wires for controlling all the coils which are preferably 24 in number.

It then remains to energize these latter from the information contained in register 33. It goes without saying that the simultaneous supply of all the coils would involve a very high current (about 2000 amps) but a very brief one (of the order of a millisecond). Each module therefore comprises a two-circuit supply. The first which is made by means of conductors 34 which may have considerable lengths brings the current to the terminals of a capacitor 35, thus placed in shunt with respect to the supply of the circuit 34. The charging of the capacitor may therefore be effected with a continuous flow of current of very low intensity (close to ten milliamps) which will therefore allow a substantial reduction in the diameter of the supply wires 34, whilst the overall continuous current remains low (of the order of 5 amps). The second circuit is intended for supplying the coils from the capacitor 35.

It is observed that each of the stages of the shift register 33 is connected at its output to one of the coils $27_1$ to $27n$ via a switch i which receives the information from said register 27*n* by a conductor 36. When the information is stabilized, the supply circuit of said switches is closed by means of a power switch 37 provided with a protection 38. The switch 37 is preferably a power transistor capable of supporting the overvoltage provoked by the self-induction of the coils at the moment of cut-off of the current. It is only after total extinction of this current that the switches i can be changed. The shift registers are then reset to zero so as to stop consumption of control current by switches 1. Energy is thus saved and heating of the printed circuits is considerably reduced whilst increasing reliability thereof.

However, it is necessary to avoid any interaction between the coils as the fluxes created thereby are opposed and the flux resulting in each coil is weaker than when they are energized separately. When they are all energized, the phenomenon is amplified and errors in selection may result therefrom.

According to the invention, the coils have been separated into two groups, i.e. those which are associated with teeth 22*b* and those which are mounted around teeth 22*c*. The coils of the first row are firstly energized, then the coils of the second. As the distance between the adjacent coils energized at the same time is increased, the interaction between their flux diminishes. The time separating the two energizations being very short (less than a millisecond), the selections may be considered as merged from the mechanical point of view, the corresponding variation for positioning the plates being less than 0.5 millimeter.

A weaving mechanism has thus been produced, intended for controlling a very large number of hooks of which the selection system made of separate modules is disposed in very precise manner with respect to the upper plate. In addition, the arrangement of the magnetic circuit eliminates any adjustment of air gap between each blade and the flexible pole piece and any adjustment of distance between said blade and the hook. Finally, dismantling or positioning of the modules is very easy due to their extremely simple assembly.

It must moreover be understood that the foregoing description has been given only by way of example and that it in no way limits the domain of the invention which would not be exceeded by replacing the details of execution described by any other equivalents.

What is claimed is:

1. An improved mechanism for selectively raising the heddle hooks of a weaving loom in response to control signals delivered by a pattern reader, the improvements comprising:

(a) a lower plate supporting the heddle hooks with their upper ends extending freely through the plate, the upper end of each hook having a beak thereon;

(b) an upper plate disposed above the lower plate;

(c) means for vertically reciprocating the plates oppositely to one-another in synchronism with the loom; and (d) selection means mounted on and moving with the upper plate above the hooks and comprising, a flexible blade for each hook having a catch at its lower end disposed to engage and catch the beak of the associated hook to raise it when the plates reciprocate apart, a ramp associated with each hook and disposed to offset the lower end of the blade to a defelected position wherein the catch is spaced away from the beak when the plates are reciprocated closest together, the blade leaving the ramp as the plates begin to separate, and electrical means operative in response to said control signals for selectively retaining each blade in deflected position offset from the beak of the associated hook or for releasing the blade to engage the beak as the plates separate.

2. The mechanism as claimed in claim 1, wherein the selection means further includes a magnetic circuit for each blade and supported therewith on the upper plate, each magnetic circuit including a pole piece with which the blade is in contact when offset in said deflected position, and magnet means associated with the pole piece and operative to hold the blade offset thereagainst or release it, and the magnet means including a coil on each pole piece connected to be selectively energized by said electrical means.

3. The mechanism as claimed in claim 2, wherein the pole pieces for multiple blades comprise a common magnetic plate having multiple mutually spaced tongues extending transversely from it, each tongue extending toward one of said blades and supporting one of said coils.

4. The mechanism as claimed in claim 2, wherein said multiple blades comprise a common reed member of magnetic material fixed opposite the common pole piece plate, and the reed member being slotted to provide said multiple blades.

5. The mechanism as claimed in claim 2, further comprising an electrical printed circuit board supported on the upper plate adjacent to said magnetic circuits and coupled to the coils supported thereon.

6. The mechanism as claimed in claim 2, wherein said selection means further include plural modular non-magnetic supports each carrying multiple magnetic circuits and each modular support having stud means engaged in holes in the upper plate to accurately locate it thereon, the supports being placed side by side in mutually interengaging relationship on the upper plate, and screw means removably fixing the respective modular supports to the upper plate.

7. The mechanism as claimed in claim 2, wherein each plate carries a bracket supporting a roller, the rollers extending respectively into slots in a fixed member and the rollers moving in the slots as the plates reciprocate, the slots being shaped to maintain the plates parallel when reciprocated close together during selection of the needles and curving to dispose the plates obliquely to each other when the plates are reciprocated further apart.

8. An improved mechanism for selecting heddle hooks to be raised in a weaving loom in response to control signals delivered by a pattern reader, wherein the mechanism includes blade means which are all reciprocated with respect to corresponding hooks in synchronism with the loom and includes catch means operative to connect the blade means with corresponding hooks which are thereby selected and includes a magnetic coil for selectively operating each catch means, the improvements comprising, means for selectively energizing the coils said means comprising a shift register having an input connected to receive said control signals and shift them down the register to its successive stages, and each stage having an output which is coupled with a corresponding magnetic coil to energize the coil.

9. The mechanism as claimed in claim 8, further including a source of electrical current, and switch means connected between the source and each corresponding magnetic coil, each switch means being coupled to an output of a shift register stage to be controlled thereby to energize the corresponding coil from the source when actuated by output from that stage.

10. The mechanism as claimed in claim 8, wherein the mechanism includes a common magnetic pole plate supporting multiple coils corresponding with multiple ones of the blade means, the pole plate having multiple tongues each extending toward an associated blade means and each supporting a coil, alternate tongues being located at different levels on the plate, and the coils at the different levels being successively energized at different times by said shift register stage outputs.

11. The mechanism as claimed in claim 9, wherein said current source comprises a capacitor and means to charge the capacitor, and a power switch coupling the capacitor to said switch means and operative after the switch means have been actuated by outputs from the shift register stages.

* * * * *